US006345148B1

(12) United States Patent
Chang

(10) Patent No.: US 6,345,148 B1
(45) Date of Patent: Feb. 5, 2002

(54) CYLINDRICAL DENATURATION STEAMING, HEATING, AND FREEZING FOOTWEAR FABRICATION MACHINE

(76) Inventor: Liang-Tsuen Chang, No. 23, Chin Kao Road, Pu Hsin Hsiang, Chang Hua County (TW)

( * ) Notice: Subject to any disclaimer, the term of this patent is extended or adjusted under 35 U.S.C. 154(b) by 0 days.

(21) Appl. No.: 09/627,158

(22) Filed: Jul. 27, 2000

(51) Int. Cl.[7] ..... A01G 13/06; H05B 11/00; A43D 89/00

(52) U.S. Cl. ..... 392/386; 219/215; 12/1 A

(58) Field of Search ..... 219/215, 521, 219/401, 402, 406; 12/1 A, 1 W, 33.2, 18.5, 53.1; 392/324, 333, 336, 337, 379, 386, 387

(56) References Cited

U.S. PATENT DOCUMENTS 2,549,981 A * 4/1951 Maeser et al. ..... 12/41.5
3,105,891 A * 10/1963 Gibbard et al. ..... 219/215
3,199,130 A * 8/1965 Sprague, Jr. ..... 12/4.1
3,256,420 A * 6/1966 Werman ..... 219/215
4,202,066 A * 5/1980 Hanson ..... 12/1 A
4,517,442 A * 5/1985 Price et al. ..... 219/215
4,598,193 A * 7/1986 Hanson ..... 219/215
4,777,733 A * 10/1988 Usuiwa et al. ..... 34/429
4,876,434 A * 10/1989 Hanson et al. ..... 219/215

* cited by examiner

*Primary Examiner*—Sang Paik
(74) *Attorney, Agent, or Firm*—Troxell Law Office PLLC

(57) ABSTRACT

A cylindrical footwear fabrication machine having a disk-shaped conveyance unit, enabling an effective increase of the steam moisturization and shaping period of footwear without occupying inordinate space and saving manpower expenditures. A pneumatic pressure cylinder impelled main drive shaft is mounted to a latticed equally divided revolving platter, providing for the synchronous rotation of the revolving platter. The steaming device includes a water trough situated below the revolving platter and electrical heating tubes disposed inside the water trough providing for the upward evaporation of the hot water steam. The refrigeration device includes a condenser and an evaporator at upper and lower ends of the footwear fabrication machine and a plurality of air intake holes. The heating device is situated below the revolving platter and includes a blast fan and a plurality of air intake holes formed in the top end of the footwear fabrication machine. Electrical heating tubes are situated in a surrounding pipeline. Air is suctioned out by the blast fan at the bottom of the revolving platter, directed into the pipeline and, after being heated by the electrical heating tubes, into the heating device through the air intake holes in the top end.

8 Claims, 7 Drawing Sheets

CYLINDRICAL DENATURATION STEAMING, HEATING, AND FREEZING FOOTWEAR FABRICATION MACHINE

BACKGROUND OF THE INVENTION

1) Field of the Invention

The invention herein relates to a cylindrical denaturation steaming, heating, and freezing footwear fabrication machine consisting of a pneumatic pressure cylinder impelled main drive shaft and, furthermore, the bottom end of the main drive shaft is center mounted to a latticed equally divided revolving platter, with the main drive shaft providing for the synchronous rotation of the equally divided revolving platter for the steaming, heating, and freezing processes utilized in the shaping of footwear and in which a disk-shaped conveyance unit replaces the conventional long conveyer belt driven method such that the reduction of conveyance unit standing area in principle enables an increase in the footwear fabrication period, virtually no occupance of space, the saving of manpower expenditures, and a cylindrical footwear fabrication machine having the three practical functions of steaming, heating, and freezing.

2) Description of the Prior Art

In the conventional footwear manufacturing process, shaping machines are directly positioned along a long driven conveyor belt to provide for the predetermined processes of footwear steaming, heating, and freezing; the length of the driven conveyer belt is coordinated with the footwear shaping periods required and most conveyor belts are typically more than 10 meters in length to be of sufficient dimension to allow for footwear heating, softening, and shaping and, therefore, such conveyor belts occupy an excessive amount of space; furthermore, since a conveyor belt is required at each shaping machine and working personnel respectively assigned to facilitate the rapid exchange and removal of footwear, this results in working personnel expenditures that do not conform to the times.

In view of the said shortcomings, the inventor of the invention herein improved the design based upon extensive experience in footwear production machinery, which culminated in the successful development of the present invention.

SUMMARY OF THE INVENTION

The primary objective of the invention herein is to provide a cylindrical denaturation steaming, heating, and freezing footwear fabrication machine consisting of a pneumatic pressure cylinder impelled main drive shaft and, furthermore, the bottom end of the main drive shaft is center mounted to a latticed equally divided revolving platter, with the main drive shaft providing for the synchronous rotation of the equally divided revolving platter and thereby the separate steaming, heating, and freezing processes required in the moisturization, softening, and shaping of footwear, wherein the said steaming device consists of a water trough situated at the bottom end of the equally divided revolving platter and, furthermore, electrical heating tubes are disposed inside the water trough and the water trough contains hot water, thereby providing for the upward evaporation of the hot water steam from the bottom end of the equally divided revolving platter for the steam moisturization and softening process of footwear; the refrigeration device consists of a condenser and an evaporator situated at the upper end and lower end, respectively of the footwear fabrication machine and, furthermore, air intake holes are distributed in their circumferences to provide for the transfer of refrigerant into the evaporator with a blast fan inducting through the air intake holes, thereby constituting the cooled air cycle convection; the said heating device has situated at the bottom end of the equally divided revolving platter a blast fan and, furthermore, a plurality of air intake holes formed in the top end of the footwear fabrication machine, with electrical heating tubes situated in a surrounding pipeline; gas is suctioned out by the blast fan at the bottom end of the equally divided revolving platter, directed into the pipeline and, after being heated by the electrical heating tubes, into the heating device through the air intake holes, thereby constituting the heat cycle pipeline; as such, the cylindrical footwear fabrication machine of the invention herein performs three footwear production processes, which is among its innovative features.

Another objective of the invention herein is to provide a cylindrical denaturation steaming, heating, and freezing footwear fabrication machine in which the cylindrical cyclically driven conveyance unit of the said footwear fabrication machine replaces the conventional long conveyer belt driven method and, furthermore, the placement of the same quantity of footwear on the equally divided revolving platter over the conveyance unit provides for the circling around of each pair of footwear on the cycling equally divided revolving platter inside the footwear fabrication machine, enabling the conveyance unit to not decrease but effectively increase the steam moisturization and shaping period of the footwear and, without in principle occupying inordinate space, complete the three footwear fabrication processes of steaming, heating, and freezing.

Yet another objective of the invention herein is to provide a cylindrical denaturation steaming, heating, and freezing footwear fabrication machine, wherein since the said conveyance unit is a cylindrical cyclically driven conveyance device, the footwear access positioning is such that after one revolution and the footwear returns to the original position which remains the same throughout the rotation, therefore, a single working personnel can easily remove the footwear thereby effectively saving manpower expenditures, unlike conventional conveyance units in which during the operation of the lengthy conveyor belt working personnel must be respectively stationed at each of the two ends to facilitate handling.

The enable a further understanding by the examination committee of the structural innovations and operation of the invention herein, the brief description of the drawings below are followed by the detailed description of the invention.

BRIEF DESCRIPTION OF THE DRAWINGS

FIG. 3-A is an orthographic drawing of the electrical heating tube distribution of the steaming device of the invention herein.

FIG. 5-A is an orthographic drawing of the heating device of the invention herein as viewed from a lateral perspective.

FIG. 6-B is an orthographic drawing of the invention herein during operation, as viewed from the top (2).

DETAILED DESCRIPTION OF THE INVENTION

Figure 1:
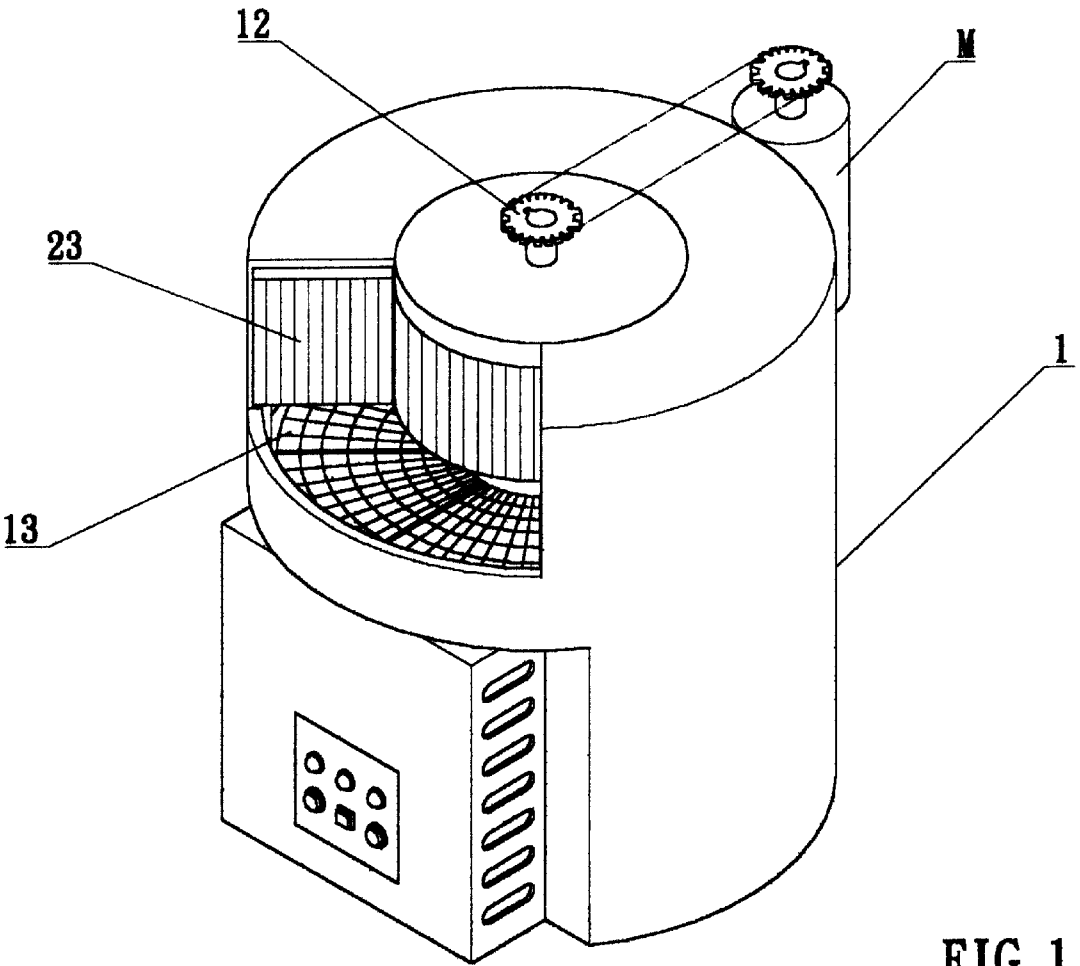
FIG. 1 is an isometric drawing of steaming device of the invention herein.
Figure 2:
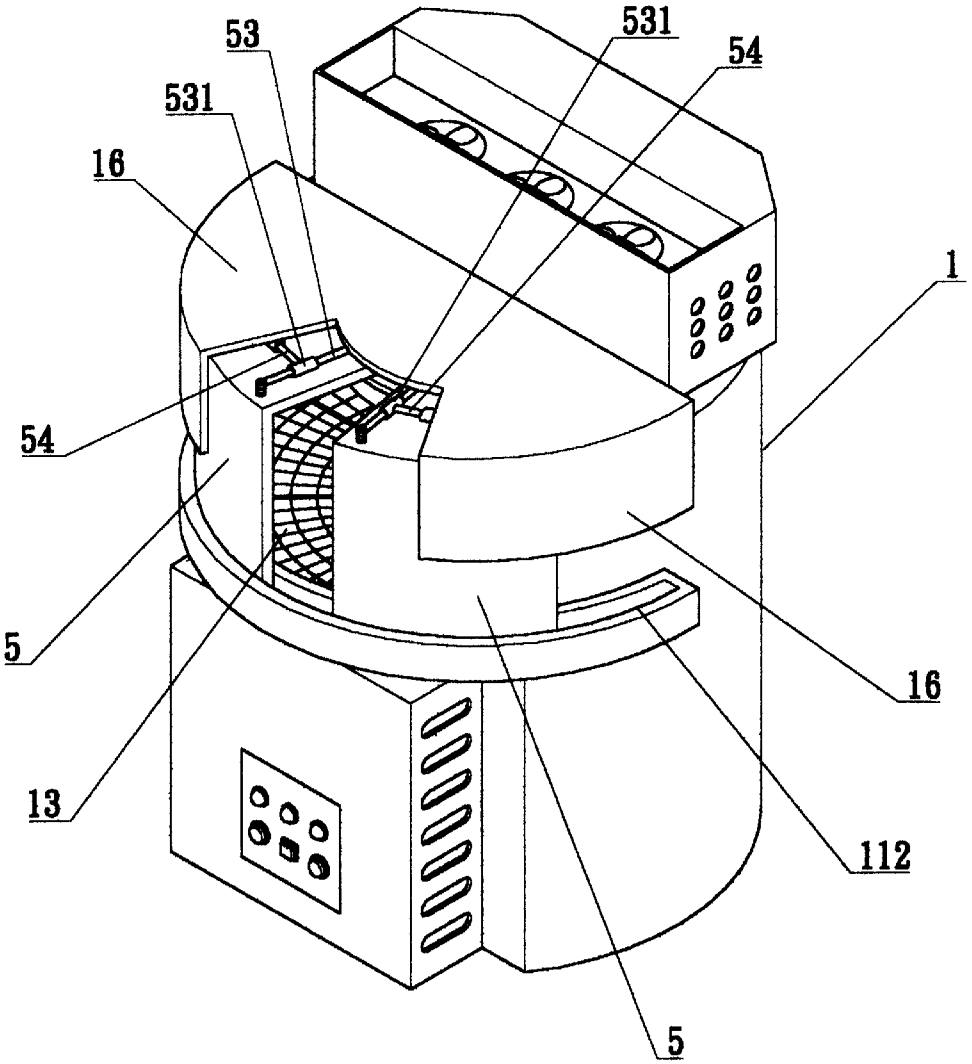
FIG. 2 is an isometric drawing of the heating and refrigeration device of the invention herein.

Referring to FIG. 1 and FIG. 2, the structural arrangement of the invention herein is clearly understood, with the invention herein referring to a cylindrical steaming, heating, and freezing footwear fabrication machine having a disk-shaped conveyance unit that replaces the conventional long conveyer belt driven method, wherein:

The said footwear fabrication machine 1 consists of a pneumatic pressure cylinder impelled main drive shaft 12 and, furthermore, the bottom end of the main drive shaft 12 is center mounted to a latticed equally divided revolving platter 13, with the main drive shaft 12 providing for the synchronous rotation of the equally divided revolving platter 13; situated on the circular surface of the footwear fabrication machine 1 is a breach-profiled footwear access slot 11 that provides for footwear removal and placement and, furthermore, the latticed structural pattern of the equally divided revolving platter 13 provides for the upward and downward circulation of gases through the equally divided revolving platter 13 to enable the three footwear fabrication processes of steaming, heating, and freezing involved in the production of footwear.

Figure 3A:
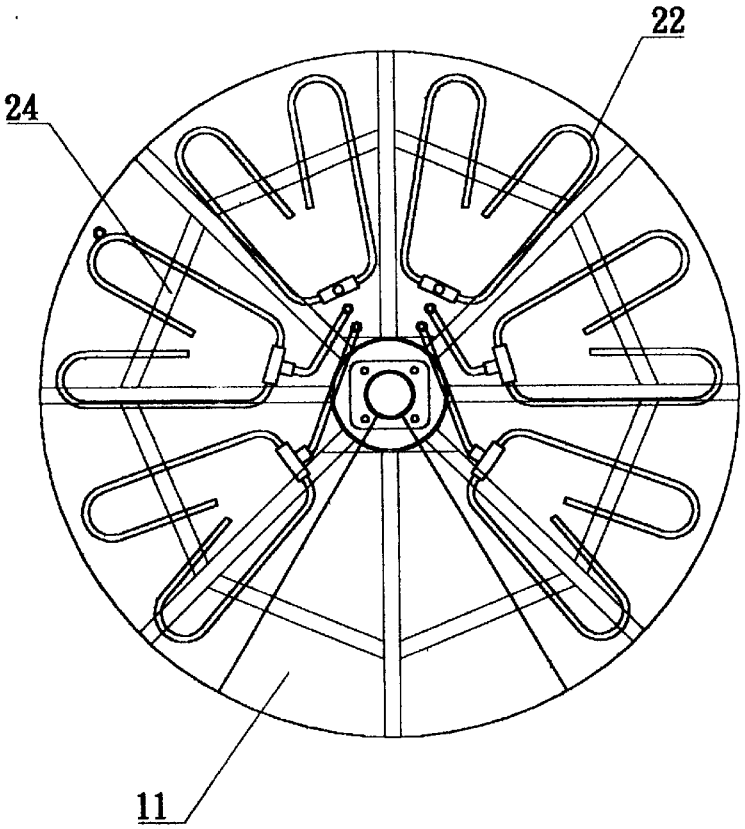
FIG. 3 is an orthographic drawing of the steaming device of the invention herein.
Figure 3:
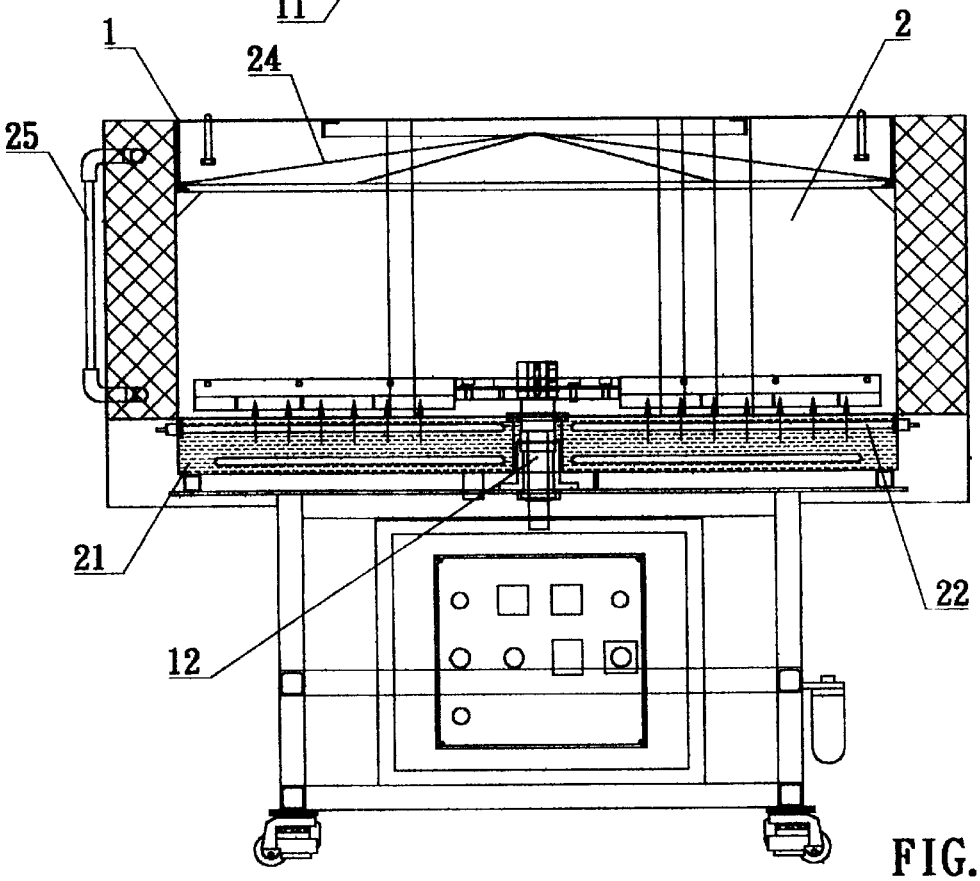

Referring to FIG. 3, the orthographic drawing of the steaming device of the invention herein, the said steaming device 2 consists of a water trough 21 situated at the bottom end of the equally divided revolving platter 13 and, furthermore, the water trough 21 contains hot water and, furthermore, electrical heating tubes 22 are disposed inside the water trough 21, with the distribution of the said electrical heating tubes 22 staggered at the position of the footwear access slot 11 (as indicated in FIG. 3-A); situated over the top end of the steaming device 2 is a centered, slant edged umbrella-shaped top cover 24; the electrical heating tubes 22 are capable of maintaining the heat of the hot water in the water trough 21, providing for the continuous upward evaporation of the hot water steam from the bottom end of the equally divided revolving platter 13 and then its runoff downward along the slanted edge of the umbrella-shaped top cover 24 which constitutes the heat cycle inside the steaming device 2 and, furthermore, viewably situated at the outer side of the steaming device 2 is a water level sighting tube 25 of which, after the water level decreases below a certain height, the water volume is automatically refilled; furthermore, placed at the two sides of the footwear access slot 11 is a shield 23 that prevents the escape of steam and thereby increases the steam moisturization and softening of footwear.

Figure 4A:
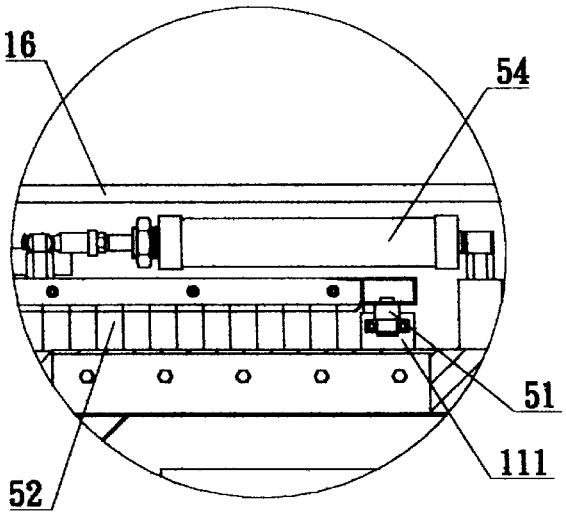
FIG. 4A is an enlarged view of area A in FIG. 4.
Figure 4:
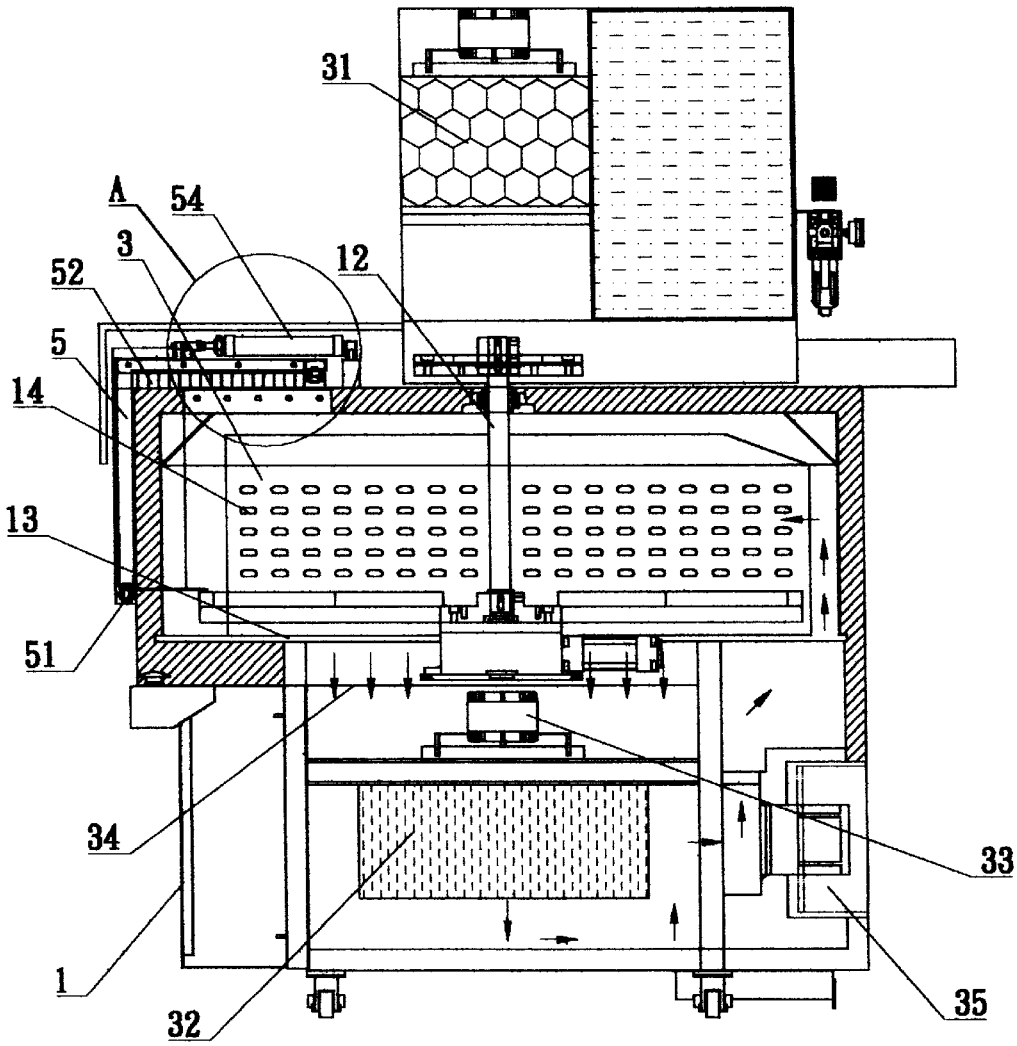
FIG. 4 is an orthographic drawing of the refrigeration device of the invention herein as viewed from the front.
Figure 6B:
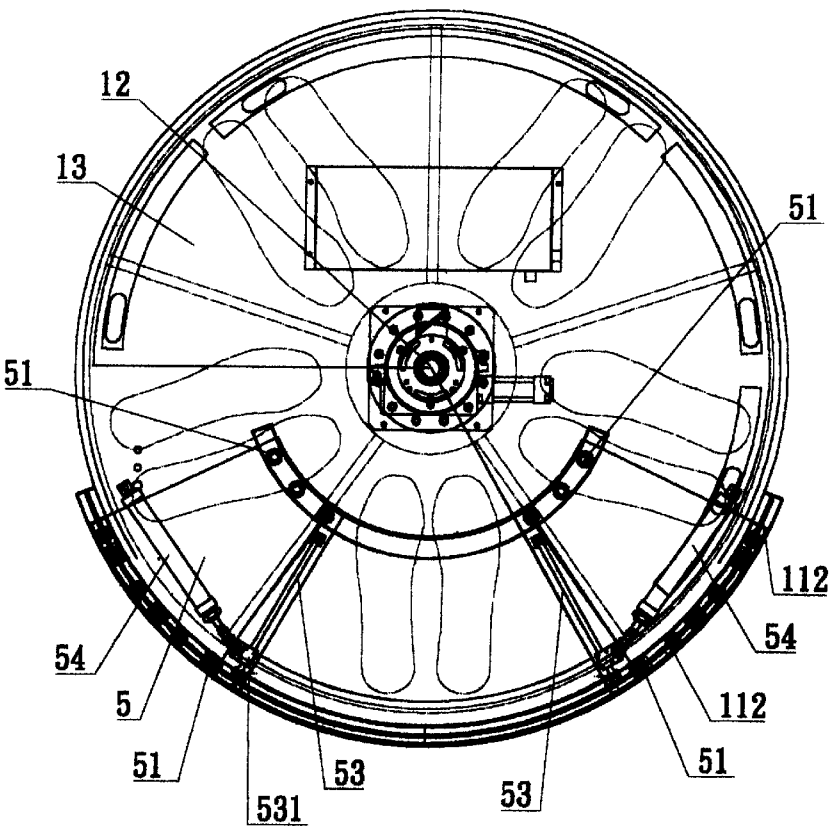
FIG. 6-A is an orthographic drawing of the invention herein during operation, as viewed from the top (1).
Figure 6A:
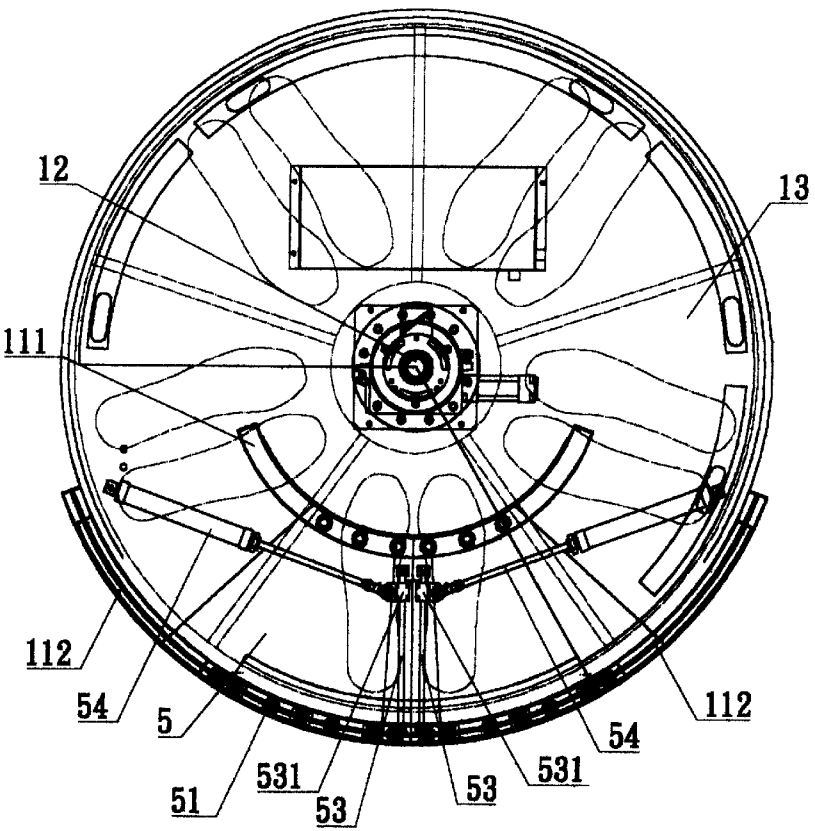

Referring to FIG. 4 and FIG. 6, the said refrigeration device 3 consists of a refrigerant condenser 31 situated at the upper end of the footwear fabrication machine 1, with an extreme cold evaporator 32 situated at the lower end and, furthermore, positioned between the condenser 31 and the evaporator 32 is a fan 33 and disposed at the top end of the fan 33 is a filter screen 34; furthermore, formed in the interior section of the footwear fabrication machine 1 top end and circumference are a plurality of air intake holes 14 such that when the refrigerant passes through the condenser 31 filter screen 34 and is transferred from the pipeline to the evaporator 32, the cooled air of the evaporator 32 is inducted by a blast fan 35 and, furthermore, directed over the pipeline into the refrigeration device 3 through the air intake holes 14 at its top end and circumference; at which time, the cooled air is exhausted by the fan 33, cleaned by the filter screen 34, and then blown into the condenser 31, which constitutes the cooled air cycle convection; disposed at the upper and lower ends at the circumferential edges of the footwear fabrication machine 1 top end and footwear access slot 11, respectively are slide rails 111 and 112, with a bearing 51 of a sealed door 5 at the contact end providing for movement against the slide rails 111 and 112 and, furthermore, situated between the sealed door 5 and the top end of the footwear fabrication machine 1 is a shield 52 that prevents gaseous escape; mounted at the opening end of the sealed door 5 is a connecting rod 53 and, furthermore, situated on the connecting rod 53 is a linear-type bearing 531 and pivotably conjoined to its other end is a pneumatic pressure cylinder 45 at the top end of the footwear fabrication machine 1; as such, when the pneumatic pressure cylinder 54 actuates the opening of the sealed door 5, as coupled onto the connecting rod 53, the linear-type bearing 531 conjoined around the pneumatic pressure cylinder 54 slides on the connecting rod 53, providing for the movement capacity of the pneumatic pressure cylinder 54 during its extension and retraction opening and closing of the footwear fabrication machine 1 for the removal of footwear (as indicated in FIG. 6), thereby achieving the footwear shaping performance of the cylindrically driven method; furthermore, the footwear access slot 11 has a surrounding protective hood 16 that prevents accidental contact and bum injuries to working personnel.

Figure 5:
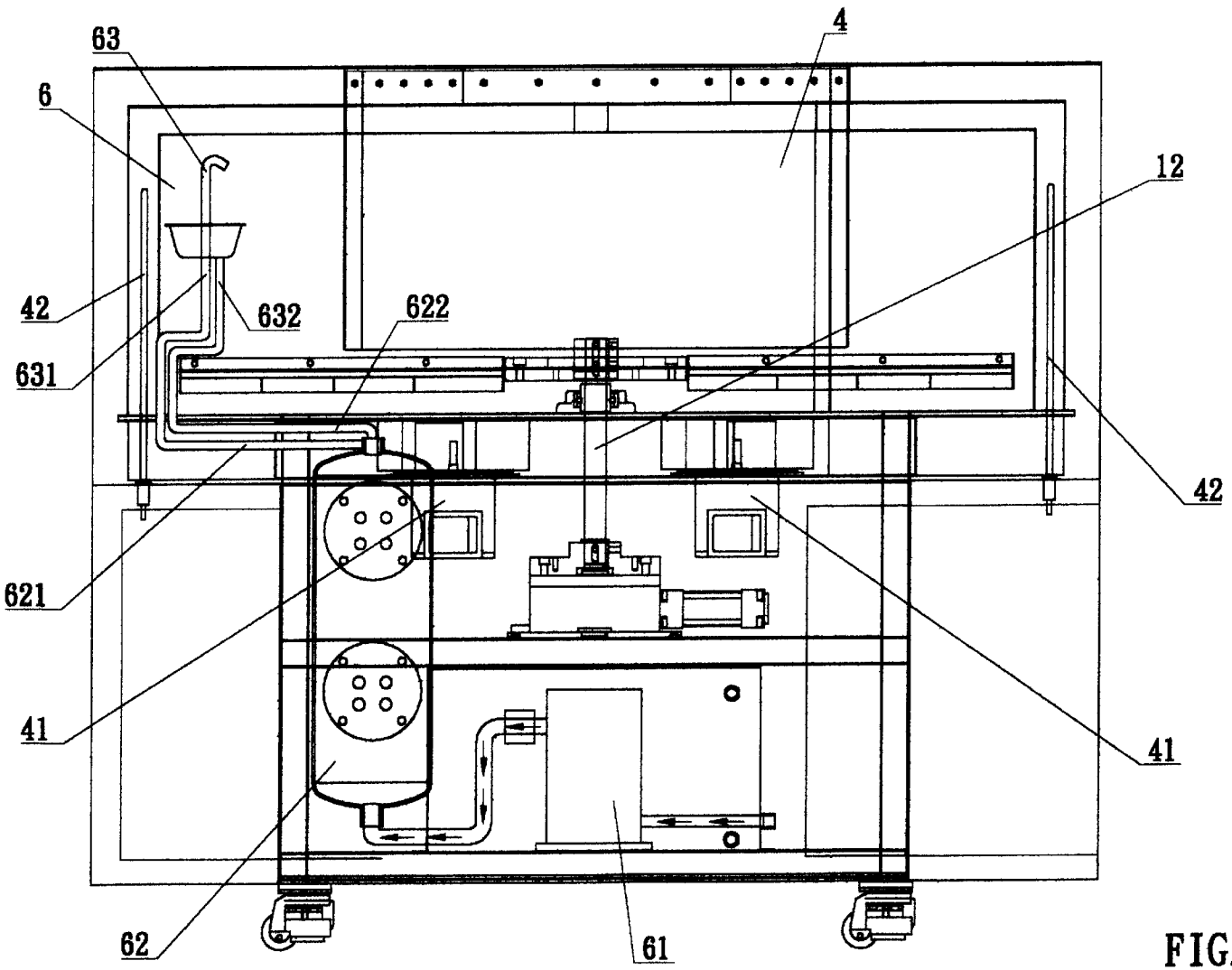
FIG. 5 is an orthographic drawing of the heating device of the invention herein as viewed from the front.
Figure 5A:
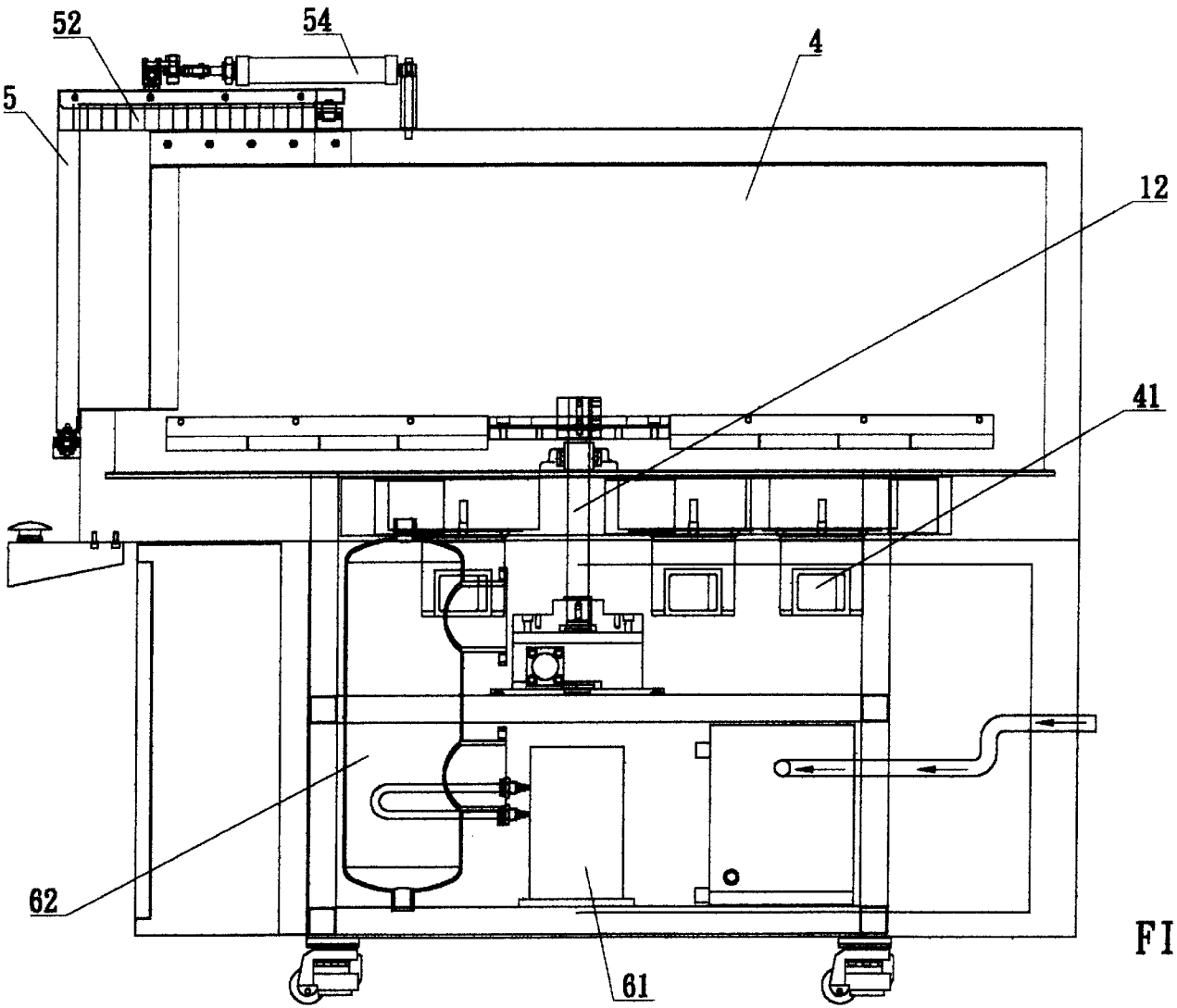

Referring to FIG. 5 and FIG. 6, the said heating device 4 has situated at the bottom end of the equally divided revolving platter 13 a blast fan 41 and, furthermore, air intake holes 14 in the inner top end of the footwear fabrication machine 1, with electrical heating tubes 42 situated in the surrounding pipeline that continuously provides for high temperature heating in the interior section of the footwear fabrication machine 1; gas filling the interior section of the footwear fabrication machine 1 is suctioned out by the blast fan 41 at the bottom end of the equally divided revolving platter 13, directed into the pipeline, and, after being heated by the electrical heating tubes 42, inputted into the heating device 4 through the air intake holes 14 in the top end and then expelled from the bottom end of the equally divided revolving platter 13, thereby constituting the heat cycle pipeline; additionally, a sealed door 5 is situated over the footwear access slot 11 of the footwear fabrication machine 1 and, furthermore, the sealed door 5 is actuated open and closed by the pneumatic pressure cylinder 54 to allow the removal of footwear (as indicated in FIG. 6), and positioned at the side of the said footwear fabrication machine 1 on the equally divided revolving platter 13 is a shield 43 that prevents the leakage of aspirated steam and increases the steam moisturization and softening of footwear.

The said humidifier structure 6 is installed at the bottom end of the heating device 4 and, furthermore, is comprised of a check valve 611 of a pump 61 disposed at its side, with the pipeline and the pump 61 interconnected and, furthermore, an outlet opening 621 and an inlet opening 622 of a steam moisturizer 62 are respectively formed at the top end that are also in continuity with the steam moisturizer 62 via the pipeline and, furthermore, an inlet opening 631 and an outlet opening 632 of an atomizing device 63 are respectively formed at the bottom end; water is directed in from the exterior side and after being channeled into the steam moisturizer 62 under pressurization by the pump 61, flows though the outlet opening 621 into the atomizing device 63 and discharged from the atomizing device 63 as a fine mist to first steam moisturize the footwear, following which the equally divided revolving platter 13 carries the footwear into the heating device 4 for heat shaping.

For the operation approach, as indicated in FIG. 6, the cylindrical cyclically driven conveyance unit of the said footwear fabrication machine 1 replaces the conventional long conveyer belt driven method and, furthermore, the placement of the same quantity of footwear on the equally divided revolving platter 13 over the conveyance unit provides for the circling around of each pair of footwear on the cycling equally divided revolving platter 13 inside the footwear fabrication machine 1, enabling the conveyance unit to not decrease but effectively increase the steam moisturization and shaping period of footwear and, without in principle occupying inordinate space, complete the three shaping processes of steaming, heating, and freezing; furthermore, since the said conveyance unit is a cylindrical cyclically driven conveyance device, the footwear access positioning is such that after one revolution, the footwear returns to the original position which remains the same throughout the rotation, therefore, a single working personnel can easily remove footwear thereby effectively saving manpower expenditures, unlike the conventional conveyance unit in which during the operation of a lengthy conveyor belt working personnel must be respectively stationed at each of the two ends to facilitate handling; as such, the cylindrical footwear fabrication machine of the present invention occupies virtually no space and reduces manpower, while being capable of three footwear production processes.

In summation of the foregoing section, since the invention herein is of an innovative structure that is capable of achieving each of its required objectives, the present invention is lawfully submitted in application for review and the granting of the commensurate patent rights.

What is claimed is:

1. A cylindrical denaturation steaming, heating, and freezing footwear fabrication machine, the footwear fabrication machine comprising: a pneumatic pressure cylinder impelled main drive shaft, a bottom end of the main drive shaft being center mounted to a latticed equally divided revolving platter, the main drive shaft providing for the synchronous rotation of the revolving platter; a breach-profiled footwear access slot situated on a circular surface of the footwear fabrication machine that provides for footwear removal and placement; a steaming device to provide steam within the fabrication machine; a refrigeration device to provide a cold gas within the fabrication machine; and a heating device to provide a heated gas within the fabrication machine; the revolving platter having a latticed structural pattern which provides for upward and downward circulation of gases through the revolving platter to enable the steaming, heating, and freezing of footwear on the revolving platter.

2. The footwear fabrication machine of claim 1, wherein the steaming device comprises a water trough situated below the revolving platter and electrical heating tubes disposed inside the water trough such that the said electrical heating tubes heat water in the water trough, providing for the continuous upward evaporation of the hot water steam from the bottom of the revolving platter; and shields located at two sides of the footwear access slot to prevent the escape of steam.

3. The footwear fabrication machine of claim 1, wherein the refrigeration device comprises a refrigerant condenser situated at an upper end of the footwear fabrication machine, and an evaporator situated at a lower end thereof; a fan positioned between the condenser and the evaporator the fan having a filter screen; a plurality of air intake holes formed in an interior section of the top end of the footwear fabrication machine such that cooled air from the evaporator is inducted by the fan through the air intake holes; and a sealed door situated over the footwear access slot to control the opening and closing of the refrigeration device.

4. The footwear fabrication machine of claim 1, wherein the heating device is situated below the revolving platter and has a blast fan and a plurality of air intake holes in an inner top end of the footwear fabrication machine; electrical heating tubes situated in a surrounding pipeline providing for high temperature heating in an interior of the footwear fabrication machine; whereby air in the interior of the footwear fabrication machine is suctioned out by the blast fan and, after being heated by the electrical heating tubes, inputted into the air intake holes.

5. The footwear fabrication machine of claim 3, further comprising slide rails disposed at an upper end of the footwear fabrication machine top end and over the footwear access slot with a bearing of the sealed door providing for movement against the slide rails; a shield situated between the sealed door and the top end of the footwear fabrication machine to prevent gaseous escape; a connecting rod mounted at an opening end of the sealed door having a linear bearing and pivotably conjoined to a pneumatic pressure cylinder such that the pneumatic pressure cylinder actuates the opening and closing of the sealed door.

6. The footwear fabrication machine of claim 2, further comprising a central, slant edged umbrella-shaped top cover situated over a top of the steaming device.

7. The footwear fabrication machine of claim 4, further comprising: a shield positioned at a side of the footwear fabrication machine on the revolving platter to prevent leakage of aspirated steam; and a humidifier structure at a bottom of the heating device.

8. The footwear fabrication machine of claim 4, further comprising slide rails disposed at an upper end of the footwear fabrication machine top end and over the footwear access slot with a bearing of the sealed door providing for movement against the slide rails; a shield situated between the sealed door and the top end of the footwear fabrication machine to prevent gaseous escape; a connecting rod mounted at an opening end of the sealed door having a linear bearing and pivotably conjoined to a pneumatic pressure cylinder such that the pneumatic pressure cylinder actuates the opening and closing of the sealed door.

* * * * *